United States Patent [19]

Alston

[11] 4,154,052

[45] May 15, 1979

[54] AUTOMATIC CLEANING SYSTEM FOR OPEN-END SPINNING APPARATUS

[75] Inventor: Otis B. Alston, Wetumpka, Ala.

[73] Assignee: Dixie Yarns, Inc., Chattanooga, Tenn.

[21] Appl. No.: 876,134

[22] Filed: Feb. 8, 1978

[51] Int. Cl.[2] ..... D01H 11/00

[52] U.S. Cl. ..... 57/302

[58] Field of Search ..... 57/56, 34 R, 58.89–58.95

[56] References Cited

U.S. PATENT DOCUMENTS

| | | | |
|---|---|---|---|
| 3,339,359 | 12/1968 | Ripka et al. | 57/58.89 |
| 3,360,917 | 12/1968 | Kubovy et al. | 57/58.95 |
| 3,360,918 | 12/1968 | Doudlebsky et al. | 57/58.95 |
| 3,439,488 | 4/1969 | Bocil et al. | 57/58.95 |
| 3,487,626 | 12/1970 | Rajnoha et al. | 57/58.91 |
| 3,524,312 | 8/1970 | Landwehrkamp | 57/56 |
| 3,597,911 | 8/1971 | Schiltknecht | 57/56 |
| 3,760,577 | 9/1973 | Kihara et al. | 57/56 |
| 3,777,466 | 12/1973 | Kabele et al. | 57/58.89 |
| 3,798,886 | 3/1974 | Rajnoha et al. | 57/58.89 X |
| 3,869,851 | 3/1975 | Muller | 57/56 X |
| 4,008,561 | 2/1977 | Grau | 57/56 |

OTHER PUBLICATIONS

Suessen Technical Information, Bulletin No. 5.1-02200E.

Technical Background of Toyoda Open-End Spinning Machine, T. Tooka, Toyoda Automatic Loom Works, Ltd.

Textile Information Center, Literature Surveys, Open End Spinning Patents, 1966–1971 & 1972–1977.

*Primary Examiner*—Donald Watkins

*Attorney, Agent, or Firm*—Stevens, Davis, Miller & Mosher

[57] ABSTRACT

An aero-mechanical open-end spinning machine including spinning rotor cleaning means such as a fibrous brush or air jet for continuously agitating any foreign matter on the interior surface of the spinning rotor so that same may exit in the airstream accompanying the open-end spun yarn.

7 Claims, 6 Drawing Figures

AUTOMATIC CLEANING SYSTEM FOR OPEN-END SPINNING APPARATUS

BACKGROUND

This invention relates to systems for open-end spinning, and particularly to systems for continuously cleaning aero-mechanical open-end spinning apparatus, especially the spinning rotor or turbine thereof.

The technique for open-end spinning is a process of separating staple fibers from an input feedbunch and transporting them to a revolving open-end reassembly and twisting point to form a yarn. There are at least three main approaches to open-end spinning: aerodynamic systems, electro-mechanical systems, and aero-mechanical systems.

In aero-dynamic systems, a spiral airflow is produced downwardly in a tube into which separated staple fibers are introduced by means of a secondary air inlet. A seed yarn is introduced into the spiral flow, and the separated fibers gather on its tail. The seed yarn is withdrawn from the tube and, as it is withdrawn, the staple fibers gathered on it are twisted by the rotation of the yarn in the airstream. The yarns produced by this method are, however, weak and irregular.

In electro-mechanical systems, electrostatic forces generated from high potentials (on the order of 30 kilovolts) transport the separated staple fibers from a drafting system, and hold them in control during the mechanical twisting action imparted by a rotating needle basket.

In aero-mechanical systems, the separated staple fibers are delivered along with the air stream into a revolving rotor (often referred to as a spinning rotor or turbine), forming a fiber ring around the periphery thereof. A seed yarn is introduced into the rotor, and its tail collects the fibers lying around the periphery. The fibers so collected are twisted into the yarn by the rotation of the rotor as the seed yarn is withdrawn. This is a system of open-end spinning which has been commercially exploited. Machines employing this system include that manufactured by Toyoda Automatic Loom Works, Ltd. of Aichi-Ken, Japan, known as Model BS, and that manufactured by Schurr, Stahlecker & Grill GmbH, Suessen, West Germany, known as the Suessen Open-End Spintester. Such open end spinning machines have been described in detail in numerous publications and patents.

Despite its commercialization, the yarn produced by present aero-mechanical systems is initially produced at a given quality level, but that yarn quality gradually deteriorates as bits of lint and particles of other foreign substances build up on the interior surface of the spinning rotor or turbine. As a result the rotors on present commercial open-end spinning equipment have to be cleaned frequently on a regular schedule.

BRIEF SUMMARY OF THE INVENTION

It is the object of the present invention to provide an open-end spinning system which will continuously and automatically avoid accumulation of foreign matter inside the spinning rotor or turbine, thereby increasing the quality of the resultant yarn.

The foregoing object and others are accomplished in accordance with the present invention by employment in an open-end spinning system of spinning rotor cleaning means, which may comprise a fibrous brush or air jet extending from the material in which the yarn exit or navel of the open-end spinning apparatus is formed, and impinging upon the interior surface of the spinning rotor or turbine, to thereby continuously make airborne any particles of lint or other foreign matter entering the rotor or turbine with the yarn fiber feedstock, so that said foreign matter is evacuated from the rotor or turbine in the airstream accompanying the formed yarn exiting through the navel.

BRIEF DESCRIPTION OF THE DRAWINGS

For a better understanding of the invention, as well as other objects and further features thereof, reference is made to the following detailed disclosure of preferred embodiments of the invention taken in conjunction with the accompanying drawings thereof, wherein.

DETAILED DESCRIPTION

Figure 5:
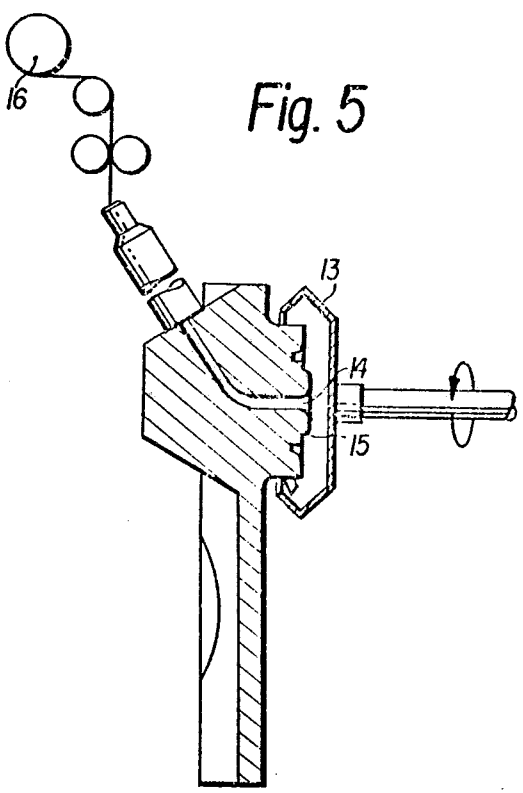
FIG. 5 is a partially schematic cross-sectional view of an exemplary open-end spinning machine like that shown in FIG. 1, except now including another embodiment of the present invention.

The manufacture of textile yarns by open-end spinning is well known. A typical open-end spinning machine includes a turbine or rotor on the interior surface of which fibers are actually spun into yarn. Silver is typically carried to that spinning rotor or turbine by a feed roller equipped with a pressing nose, and then transferred to a combing roller. Metallic wires in the shape of saw-teeth are wound around the combing roller, and comb sliver fed to that combing roller. The combed fibers are then pushed by the toothed combing rotor so that they leave the combing roller and are transferred on an airstream, shown at 11 in FIG. 1, through a port 12 leading to the inner wall of the turbine 13. The fibers are collected and spun at the largest interior diameter of the turbine. The resultant yarn is then drawn out through an exit opening 14 in navel 15 and transported to a take-up roller 16 where it is wound into a cheese.

Figure 1:
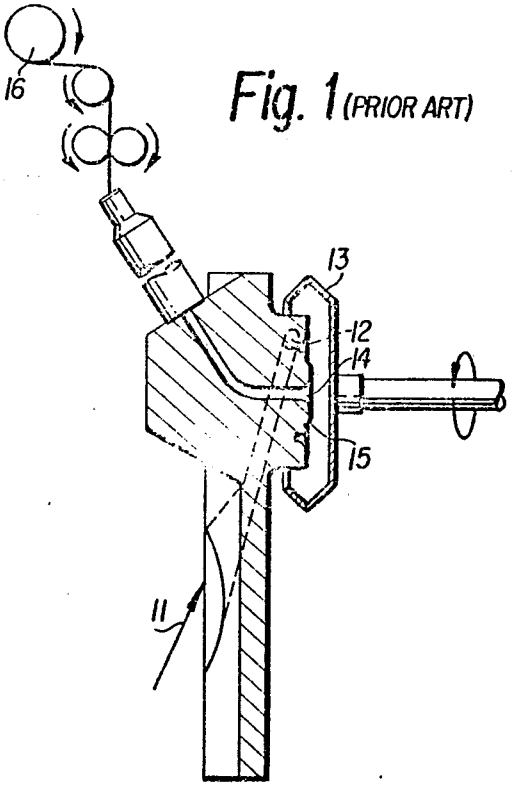
Fig. 1 (PRIOR ART)
FIG. 1 is a partially schematic, cross-sectional view of an exemplary prior art open-end spinning machine.
Figure 2:
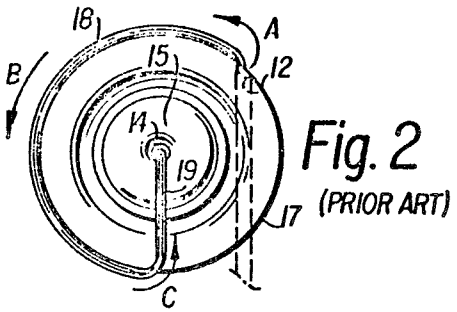
Fig. 2 (PRIOR ART)
FIG. 2 is a partially schematic, plan view of the exit navel area of a machine like that shown in FIG. 1.

As more clearly shown in FIG. 2, in one embodiment the port 12 through which the combed fibers enter the interior of the spinning rotor or turbine 13 is in an upstanding shoulder 17 which surrounds or is a part of the region of navel 15. The turbine 13 spins in a position adjacent and covering the shoulder 17 and navel 15 as shown in FIG. 1. As illustrated in FIGS. 1 and 2, the turbine rotates clockwise when one views the interior thereof. Hence, as illustrated in FIG. 2, the combed fibers emerging from port 12 commence their residence within the spinning turbine at a location around the periphery thereof which corresponds to point A, those fibers then following the path 18 in a direction B on the interior of the spinning rotor or turbine, just adjacent shoulder 17, and the resultant yarn 19 is then pulled into exit opening 14 so that the spun fibers leave the periphery of the spinning rotor or turbine at approximately point C as shown in FIG. 2. When the direction in which the point where the spun fibers leave the inner wall of the turbine moves in the same direction as that in which the turbine rotates, the condition is called "forward-direction spinning." While under certain conditions those two conditions may become opposite to produce "backward-direction spinning," forward-direction spinning" is a more stable situation in which better quality yarn is spun. This relationship between the direction of rotation of the rotor or turbine, and the yarn being spun is well known, and is explained in a publication entitled "Technical Background of Toyoda Open-End Spinning Machine," by T. Tooka, Director, Toyota Automatic Loom Works, Ltd., Aichi-Ken, Japan.

However, as explained in that same publication, if the sliver fed to an open-end spinning machine contains foreign matter such as trash, this forgign matter is deposited on the inner wall of the turbine, with the deposits becoming heavier in the course of time. Buildup of such deposits decreases the strength of the resultant yarn, increases the uneveness of the yarn, as well as other yarn defects, and increases the frequency of end breakage during open-end spinning. As explained in that publication, an earlier solution to this problem was the removal of trash from raw fibers, such as cotton, by blowing, with most of the rest of such trash being removed by a card. However, that solution was not completely satisfactory, so a further attempt at solving the problem utilized a purifying roller on a card, to thereby crush any leaf fragments remaining in the fibers into fine particles. Additionally, a tandem card equipped with two sets of purifying rollers was used for further removal of leaf fragments.

The present invention provides a new solution to the problem of foreign matter deposits building up on the inner wall of the spinning rotor or turbine and the resultant decreases in yarn quality. As shown in FIG. 2, there is a minor sector C-A of the circumference of shoulder 17 or navel 15 about which fibers do not pass during the open-end spinning process. In the advantageous system of the present invention, this free sector of the spinning apparatus is utilized as the site of means for continuously agitating any foreign matter deposits on the inner wall of the spinning rotor or turbine, and the airstream within the rotor or turbine to thereby make such foreign matter airborne, so that it is evacuated from the area within the spinning rotor or turbine in the airstream which accompanies the spun yarn leaving that area through exit port 14. In various embodiments, this inventive means may comprise a mechanical agitator such as a fibrous brush, or may comprise an airstream impinging upon the interior surface of the spinning rotor or turbine, or any other suitable means for loosening foreign matter particles deposited thereon. It is important to place the means for removing foreign matter built up upon the inner wall of the turbine in the sector C-A through which fibers being spun do not pass, since the presence of the inventive means should not disturb the fibers being twisted in the spinning rotor or turbine.

Figure 3:
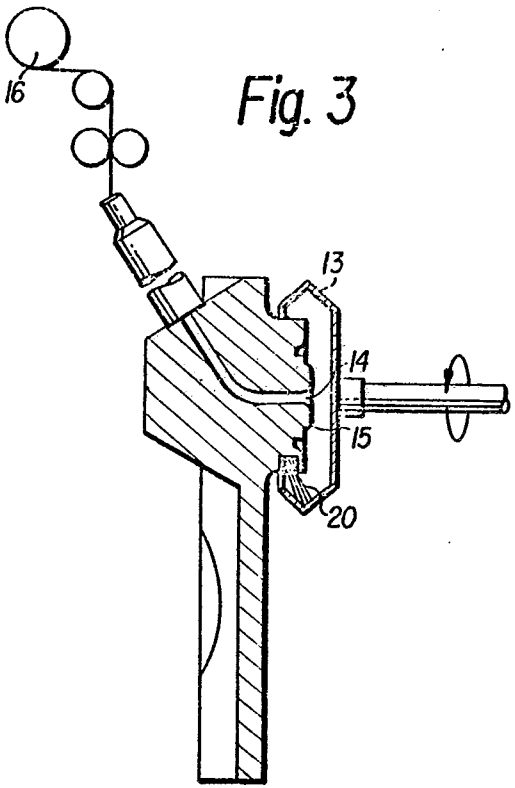
FIG. 3 is a partially schematic cross-sectional view of an exemplary open-end spinning machine like that shown in FIG. 1, except now including an embodiment of the present invention.
Figure 4:
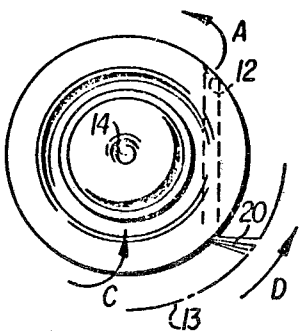
FIG. 4 is a partially schematic, plan view of the exit navel area of a machine like that shown in FIG. 3, including an embodiment of the present invention.

One specific embodiment of the presently claimed invention is shown in FIGS. 3 and 4 where a number of bristles have been inserted into a hole so that those bristles contact the largest diameter portion of the interior of the spinning rotor or turbine 13 in a manner to remove any foreign matter particles accumulated thereon, and to indeed prevent a substantial accumulation thereof. As shown in FIG. 4, the bristles 20 extend in a direction which is obliquely similar to the direction D in which spinning rotor or turbine 13 rotates so that the tips of the bristles 20 have a tendency to agitate any foreign particles from the interior surface of the rotor 13. The bristles themselves may comprise any suitable material, such as hog bristles, nylon fibers, or others cut to a length so that they just come into contact with the surface of the rotor or turbine.

Figure 6:
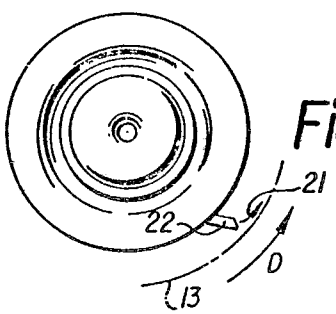
FIG. 6 is a partially schematic plan view of the exit navel area of a machine like that shown in FIG. 5 including said other embodiment of the present invention.

Still another embodiment of the present invention is shown in FIGS. 5 and 6 wherein the means for agitating and making airborne any particles of foreign material accumulated on the inner surface of the turbine comprises an air jet emerging from the region of shoulder 17 in a direction obliquely similar to the direction of rotation of rotor or turbine 13. This direction is shown by the path 21 emerging from air jet 22 as shown in FIG. 6. In various embodiments, the air jet 22 may simply be flush with the surface of shoulder 17, or may extend therefrom. Compressed air emitted through air jet 22 should have sufficient direction and velocity to remove particles of foreign matter which may have accumulated on the interior surface of the turbine, and to prevent further accumulation thereof, but the direction and velocity thereof should not be such as to interfere with the desired yarn spinning operation of the apparatus.

The advantageous cleaning system of the present invention provides a number of advantages over standard open-end spinning systems which do not make use of such a system. These advantages appear both in yarn quality and improved production efficiency. In general, the fact that the rotor or turbine is continuously cleaned maintains the quality of the yarn being spun therein at the same level hour after hour of operation. Furthermore, since the system of the present invention does not require the open-end spinning apparatus to be shut down for frequent periodic cleaning, the present system increases production time, and decreases labor costs associated with the frequent periodic cleaning required in the absence of the inventive system. The continuously cleaned open-end rotor or turbine of the present invention maintains the evenness and breaking strength of the yarn being produced thereby. Yarn breaking strength is quite important when such yarns are woven or knitted into fabric, because most fabrics have established bursting strength standards which must be met in order to be competitive in the marketplace. The present invention maintains a clean rotor which produces strong yarn. Furthermore, the reduction in ends down (i.e. broken yarns in the open-end spinning machine), reduces the number of stops and thereby increases production time and reduces costs.

The following example further specifically defines the improved open-end spinning system of the present invention. This example is intended to illustrate a preferred embodiment of the novel open-end spinning cleaning system of the present invention.

EXAMPLES I AND II

The present invention was embodied in a Suessen Open-End Spintester open-end spinning machine, manufactured by Spindelfabrik Suessen, Schurr, Stahlecker & Grill GmbH, 7334 Suessen, West Germany, which was modified by installation of cleaning brush bristles in accordance with the present invention. The cleaning bristles were installed approximately as shown in FIGS.

3 and 4 hereof so that they just contacted the interior surface of the spinning rotor at the region of its greatest internal diameter.

In the following table the data in Column I is for operation of the Suessen Open-End Spintester Machine without the present invention. Column II contains data for operation of the same machine modified as described above to embody the present invention. In both cases I and II, the machine also included an additional combing sector as disclosed in my copending application Ser. No. 871,142, filed Jan. 20, 1978, but that sector does not form a part of the present invention.

| | I | II |
|---|---|---|
| Machine | Suessen | Suessen modified |
| Fiber | Somewhat leafy 100% Cotton | Somewhat leafy 100% Cotton |
| Rotor Speed | 30,000 RPM | 30,000 RPM |
| Comber Speed | 6,000 RPM | 6,000 RPM |
| Sliver wt/yd. | 70 grains | 70 grains |
| Yarn size | 18/1 | 18/1 |
| Yarn Uniformity | decreases with build-up of foreign matter in rotor | maintains initial degree of evenness |
| Ends down | increase with build-up of foreign matter in rotor | Virtually eliminated |
| Yarn Hairiness | increases with foreign matter build-up in rotor | maintains initial less fuzzy condition |
| Rotor Cleaning Frequency | Once every 8 hours | never in 80 hours |

As shown in the table, yarns produced by the system including the present invention exhibit increased yarn uniformity, decreased yarn fuzziness, and dramatic improvement in ends down during open-end spinning, and therefore apparently greater strength. Additionally, rotor shut-down for cleaning is substantially eliminated.

Although specific components, proportions and arrangements of elements have been stated in the above description of preferred embodiments of this invention, other equivalent components and arrangements of elements may be used with satisfactory results and various degrees of quality, or other modifications may be made herein to enhance the construction of the invention to thereby increase its utility. It will be understood that such changes of details, materials, arrangements of parts, and uses of the invention described and illustrated herein, are intended to be included within the principles and scope of the claimed invention.

What is claimed is;

1. In an open-end spinning apparatus for manufacturing textile yarns, of the type comprising a cup-like turbine into which combed fibers are transported on an airstream, in which fibers are spun into yarn, and from which yarn is removed through an exit port or navel near the center around which said turbine spins, the improvement comprising means associated with said turbine for agitating, and thereby removing, foreign matter accumulated on the interior surface of the turbine during the spinning of textile yarns therein, said means being located at the periphery of the turbine in the sector thereof through which fibers do not pass during spinning of yarns therein.

2. The apparatus of claim 1 wherein said means for removing foreign matter from the interior surface of the turbine is primarily directed to removing such matter from that portion of the internal surface of the turbine which has the largest diameter.

3. The apparatus of claim 2 wherein said means comprises fibrous bristles extending from the region of said navel into contact with the interior surface of said turbine.

4. The apparatus of claim 3, wherein said bristles approach said internal surface from a direction generally similar to the direction of rotation of the turbine.

5. The apparatus of claim 4, wherein said bristles comprise a material selected from the group consisting of: hog bristles and nylon fibers.

6. The apparatus of claim 2, wherein said means for removing foreign matter from the interior surface of the turbine comprises an air jet.

7. The apparatus of claim 6, wherein said air jet impinges upon said internal surface from a direction generally similar to the direction of rotation of the turbine.

* * * * *